US006289524B1

(12) United States Patent
Wright et al.

(10) Patent No.: US 6,289,524 B1
(45) **Date of Patent: *Sep. 18, 2001**

(54) PADDED PROTECTIVE GARMENT

(75) Inventors: Alan Edward Wright; Debra Nell Welchel, both of Woodstock, GA (US)

(73) Assignee: Kimberly-Clark Worldwide, Inc., Neenah, WI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/988,123

(22) Filed: Dec. 10, 1997

(51) Int. Cl.[7] ..... A41D 13/00
(52) U.S. Cl. ..... 2/455; 2/457; 2/69; 2/79
(58) Field of Search ..... 2/455, 456, 457, 2/412, 413, 414, 16, 22, 23, 24, 69, 69.5, 51, 79, 82

(56) References Cited

U.S. PATENT DOCUMENTS

| | | | | |
|---|---|---|---|---|
| 4,257,127 | | 3/1981 | Kaupin et al. | 2/75 |
| 4,412,358 | * | 11/1983 | Lavender | 2/412 |
| 4,432,099 | * | 2/1984 | Grick et al. | 2/412 |
| 4,581,752 | | 4/1986 | De Luca | 378/62 |
| 4,670,913 | | 6/1987 | Morell et al. | 2/227 |
| 4,720,415 | | 1/1988 | Vander Wielen et al. | 428/152 |
| 5,034,998 | | 7/1991 | Kolsky | 2/2 |
| 5,052,052 | * | 10/1991 | Gilford et al. | 2/456 |
| 5,140,721 | * | 8/1992 | Kauffeld | 2/2.1 |
| 5,377,693 | * | 1/1995 | Loper et al. | 2/227 |
| 5,487,189 | | 1/1996 | Bell | 2/79 |
| 5,492,753 | * | 2/1996 | Levy et al. | 428/219 |
| 5,509,142 | * | 4/1996 | Connell et al. | 2/79 |
| 5,624,729 | | 4/1997 | Cohen et al. | 428/90 |
| 5,669,079 | * | 9/1997 | Morgan | 2/414 |
| 5,729,832 | * | 3/1998 | Grilliot et al. | 2/23 |
| 6,029,274 | * | 2/2000 | Welchel et al. | 2/69 |

FOREIGN PATENT DOCUMENTS

| | | | | |
|---|---|---|---|---|
| 2543046 | * | 4/1977 | (DE) | 2/79 |
| 2703538 | * | 8/1977 | (DE) | 2/455 |
| 3900694 | * | 7/1990 | (DE) | 2/456 |
| 0672357 A2 | | 9/1995 | (EP) . | |
| 1577493 | | 8/1969 | (FR) . | |
| 2 199 233 A | | 7/1988 | (GB) . | |
| 2199233 | * | 7/1988 | (GB) | 2/23 |
| 94/12065 | | 6/1994 | (WO) . | |
| 95/08276 | | 3/1995 | (WO) . | |

* cited by examiner

*Primary Examiner*—Michael A. Neas
(74) *Attorney, Agent, or Firm*—Scott B. Garrison; Dority & Manning, P.A.

(57) ABSTRACT

The present invention provides a disposable padded protective garment including a sheet material and at least one pad coupled to the sheet material. The disposable padded protective garment may further include a pocket coupled to the sheet material which, in turn, couples the pad to the sheet material.

21 Claims, 3 Drawing Sheets

PADDED PROTECTIVE GARMENT

FIELD OF THE INVENTION

The present invention relates to protective garments. More specifically, this invention relates to padded protective garments.

BACKGROUND

Disposable protective garments worn by workers prevent liquids or dust from reaching the skin, thereby preventing skin irritation or damage. Besides being liquid or particulate barriers, these garments may also be breathable permitting greater comfort. The desirability of disposing of the garments after use is due to the relatively high cost of washing them.

Often workers wear disposable protective garments when cleaning in wet environments, such as the interiors of brewery vessels. Unfortunately, a fall may result during cleaning. Consequently, workers often wear separate, individual pads over the garments providing a cushion if a fall should occur. In addition, it may be desirable for workers to wear separate, individual pads over disposable garments during other jobs as well, such as finishing floors or painting.

Unfortunately, the wearing of separate individual pads suffers several disadvantages. Putting the pads on takes time, thereby lengthening the completion of the job. In addition, some workers may not wear some or all of the pads, thereby increasing their risk of injury. Furthermore, often these pads are constructed from a material that absorbs liquids. When the pads absorb liquid, this liquid becomes concentrated on the garment, thereby increasing the risk of the liquid penetrating the garment and reaching the worker's skin.

Accordingly, a disposable protective garment that improves worker efficiency and protection will improve over conventional protective garments.

DEFINITIONS

As used herein, the term "nonwoven web" refers to a web that has a structure of individual fibers or filaments that are interlaid, but not in an identifiable repeating manner. Nonwoven webs have been, in the past, formed by a variety of processes known to those skilled in the art such as, for example, meltblowing, spunbonding and bonded carded web processes.

As used herein, the term "spunbonded web" refers to a web of small diameter fibers and/or filaments that are formed by extruding a molten thermoplastic material as filaments from a plurality of fine, usually circular, capillaries in a spinneret with the diameter of the extruded filaments then being rapidly reduced, for example, by non-eductive or eductive fluid-drawing or other well known spunbonding mechanisms. The production of spunbonded nonwoven webs is illustrated in patents such as Appel, et al., U.S. Pat. No. 4,340,563; Dorschner et al., U.S. Pat. No. 3,692,618; Kinney, U.S. Pat. Nos. 3,338,992 and 3,341,394; Levy, U.S. Pat. No. 3,276,944; Peterson, U.S. Pat. No. 3,502,538; Hartman, U.S. Pat. No. 3,502,763; Dobo et al., U.S. Pat. No. 3,542,615; and Harmon, Canadian Pat. No. 803,714.

As used herein, the term "meltblown fibers" means fibers formed by extruding a molten thermoplastic material through a plurality of fine, usually circular, die capillaries as molten threads or filaments into a high-velocity gas (e.g. air) stream that attenuates the filaments of molten thermoplastic material to reduce their diameters, which may be to microfiber diameter. Thereafter, the meltblown fibers are carried by the high-velocity gas stream and deposited on a collecting surface to form a web of randomly disbursed meltblown fibers. The meltblown process is well-known and is described in various patents and publications, including NRL Report 4364, "Manufacture of Super-Fine Organic Fibers" by V. A. Wendt, E. L. Boone, and C. D. Fluharty; NRL Report 5265, "An Improved device for the Formation of Super-Fine Thermoplastic Fibers" by K. D. Lawrence, R. T. Lukas, and J. A. Young; and U.S. Pat. No. 3,849,241, issued Nov. 19, 1974, to Buntin, et al.

As used herein, the term "microfibers" means small diameter fibers having an average diameter not greater than about 100 microns, for example, having a diameter of from about 0.5 microns to about 50 microns, more specifically microfibers may also have an average diameter of from about 1 micron to about 20 microns. Microfibers having an average diameter of about 3 microns or less are commonly referred to as ultra-fine microfibers. A description of an exemplary process of making ultra-fine microfibers may be found in, for example, U.S. Pat. No. 5,213,881, entitled "A Nonwoven Web With Improved Barrier Properties", incorporated herein by reference in its entirety.

As used herein, the term "sheet" refers to a material that may be a film, nonwoven web, woven fabric, knit fabric, or laminates of the like.

As used herein, the term "disposable" is not limited to single use articles, but also refers to articles that can be discarded after only a few uses. Generally, a disposable article is not intended to be cleaned by automated devices, such as a washing machine.

As used herein, the term "garment" is any article of clothing, such as a glove, sleeve protector, apron, shirt, pants, shoe, coat or coverall.

As used herein, the term "pad" refers to a cushionlike mass of soft material used as filling or for protection against falling, jarring, scraping, or other injury. A pad may be constructed from any suitable material, such as foams, textiles, fibers, plastics, bubble-pack, bulky cloth, wadding, or elastic materials, such as those disclosed in U.S. Pat. No. 4,720,415, to Vander Wielen et al., and U.S. Pat. No. 5,624,729, to Cohen et al., which disclosures are hereby incorporated by reference.

As used herein, the term "pocket" refers to at least one piece of material that secures an article, such as a pad, to a garment.

As used herein, the term "closure mechanism" is a device used to close and open a garment permitting a person to wear and remove the garment. Examples of closure mechanisms include zippers, button fasteners, clip fasteners, snap fasteners, magnetic fasteners, and hook and loop connectors.

As used herein, the term "machine direction" refers to the planar dimension of a nonwoven fibrous web, which is in the direction of travel during web formation.

As used herein, the term "cross-machine direction" refers to the planar dimension of a nonwoven fibrous web, which is the direction perpendicular to the machine direction.

As used herein, the term "liquid resistant" refers to material having a hydrostatic head of at least about 25 centimeters as determined in accordance with the standard hydrostatic pressure test AATCC TM No. 127-1980.

As used herein, the term "breathable" refers to material having a Frazier porosity of at least about 25 cubic feet per minute per square foot (cfm/ft$^2$) as determined in accordance with the standard Frazier porosity test Federal Test Method 5450, Standard no. 191A or a Moisture Vapor Transmission Rate (MVTR) of at least about 500 grams per square meter per 24 hours ($g/m^2/24$ h) as determined in accordance with the standard MVTR test method ASTM E96-80.

As used herein, the term "particle resistant" refers to a fabric having a useful level of resistance to penetration by particulates. Resistance to penetration by particulates may be measured by determining the air filter retention of dry particles and can be expressed as a particles holdout efficiency. More specifically, particle hold-out efficiency refers to the efficiency of a material at preventing the passage of particles of a certain size range through the material. Particle holdout efficiency may be measured by determining the air filter retention of dry particles utilizing tests such as, for example, IBR Test Method No. E-217, Revision G (Jan. 15, 1991) performed by InterBasic Resources, Inc. of Grass Lake, Michigan. Generally, a high particle holdout efficiency is desirable for barrier materials/fabrics. Desirably, a particle resistant material should have a particle hold-out efficiency of at least about 40 percent for particles having a diameter greater than about 0.1 micron.

As used herein, the term "polymer" generally includes homopolymers, copolymers, such as block, graft, random and alternating copolymers, terpolymers, and blends and modifications thereof. Furthermore, unless otherwise specifically limited, the term "polymer" shall include all possible geometrical configurations of the material. These configurations include isotactic, syndiotactic and random symmetries.

As used herein, the term "consisting essentially of" does not exclude the presence of additional materials that do not significantly affect the desired characteristics of a given composition or product. Exemplary materials of this sort would include pigments, antioxidants, stabilizers, surfactants, waxes, flow promoters, optical brightners, antistats, particulates or materials added to enhance processability of a composition.

As used herein, the term "couple" includes, but not limited to, joining, connecting, fastening, linking, or associating two things integrally, interstitially, directly, or indirectly together. Coupling includes using means such as stitching, ultrasonic bonding, solvent welding, adhesives, adhesive tapes, mechanical fasteners, snaps, hook and loop connectors, clips, thermal bonding, or securing an article to a member using an intermediate mechanism, such as a pocket coupled to the member.

SUMMARY OF THE INVENTION

The problems and needs described above are addressed by the present invention, which provides disposable padded protective garment including a sheet material and at least one pad coupled to the sheet material. The sheet material may further include first and second sides. In addition, the pad may be coupled to the second side. Furthermore, the second side may be located in an interior of the garment. Also, the sheet material may be less than about 5.0 millimeter thick. Moreover, the sheet material may be less than about 0.40 millimeter thick.

Still further, the disposable padded protective garment may include one or more pockets formed or coupled with the sheet material and adapted to couple at least one pad to the sheet material of the garment. In addition, the pocket may have at least three sides coupled to the sheet material. Moreover, the pocket may be coupled to the garment enclosing the pad preventing its removal. Alternatively, the pocket may include a first portion having three sides coupled to the sheet material forming a first opening and a second portion having three sides coupled to the sheet material forming a second opening in an opposing relation to the first opening permitting the inserting and removing of the pad.

Also, the disposable padded protective garment may include a body section and arm sections. Furthermore, the garment may include leg sections.

In an aspect of the invention, the disposable padded protective garment may include pads coupled to the sheet material at locations corresponding to the elbows of a wearer. In addition, the disposable padded protective garment may include pads coupled to the sheet material at locations corresponding to the elbows, knees, and tailbone of a wearer, although it is contemplated that pads may be coupled at other locations or additional pads may be coupled at other locations.

Furthermore, the pad may include a foam material. Alternatively, the pad may include a first member having a first substantially planar surface and a second surface forming a plurality of bubbles. Moreover, the pad may further include a second member having a first substantially planar surface and a second surface forming a plurality of bubbles where the second member may be positioned with its second side in opposing relation to the second side of the first member. In addition, the plurality of bubbles of the second member may be offset with the plurality of bubbles of the first member.

Also, the sheet material may be formed from a polymer, an ethylene and vinyl monomer copolymer, an ethylene and n-butyl acrylate copolymer, a cellulosic material, or an acrylic resin. Furthermore, the sheet material may contain multiple layers.

Another embodiment of the invention is a method of making a disposable padded protective garment. The method includes the steps of providing a sheet material and a means for coupling a pad to the sheet material. The means for coupling may be a pocket coupled to the sheet material. Alternatively, the means for coupling may be selected from the group consisting of stitching, ultrasonic bonding, solvent welding, adhesives, adhesive tapes, mechanical fasteners, snaps, hook and loop connectors, clips, or thermal bonding.

Moreover, the pad may include a first member having a first substantially planar surface and a second surface forming a plurality of bubbles. In addition, the pad may further include a second member having a first substantially planar surface and a second surface forming a plurality of bubbles where the second member may be positioned with its second surface in opposing relation to the second surface of the first member. Moreover, the plurality of bubbles of the second member may be offset with the plurality of bubbles of the first member.

A further embodiment of the invention is a pad for a disposable protective garment having a first member and a second member. The first member has a first substantially planar surface and a second surface forming a plurality of bubbles. The second member has a first substantially planar surface and a second surface forming a plurality of bubbles where the second member may be positioned with its second surface in opposing relation to the second surface of the first member. Moreover, the plurality of bubbles of the second member may be offset and interlocked with the plurality of bubbles of the first member.

DETAILED DESCRIPTION

Figure 1:
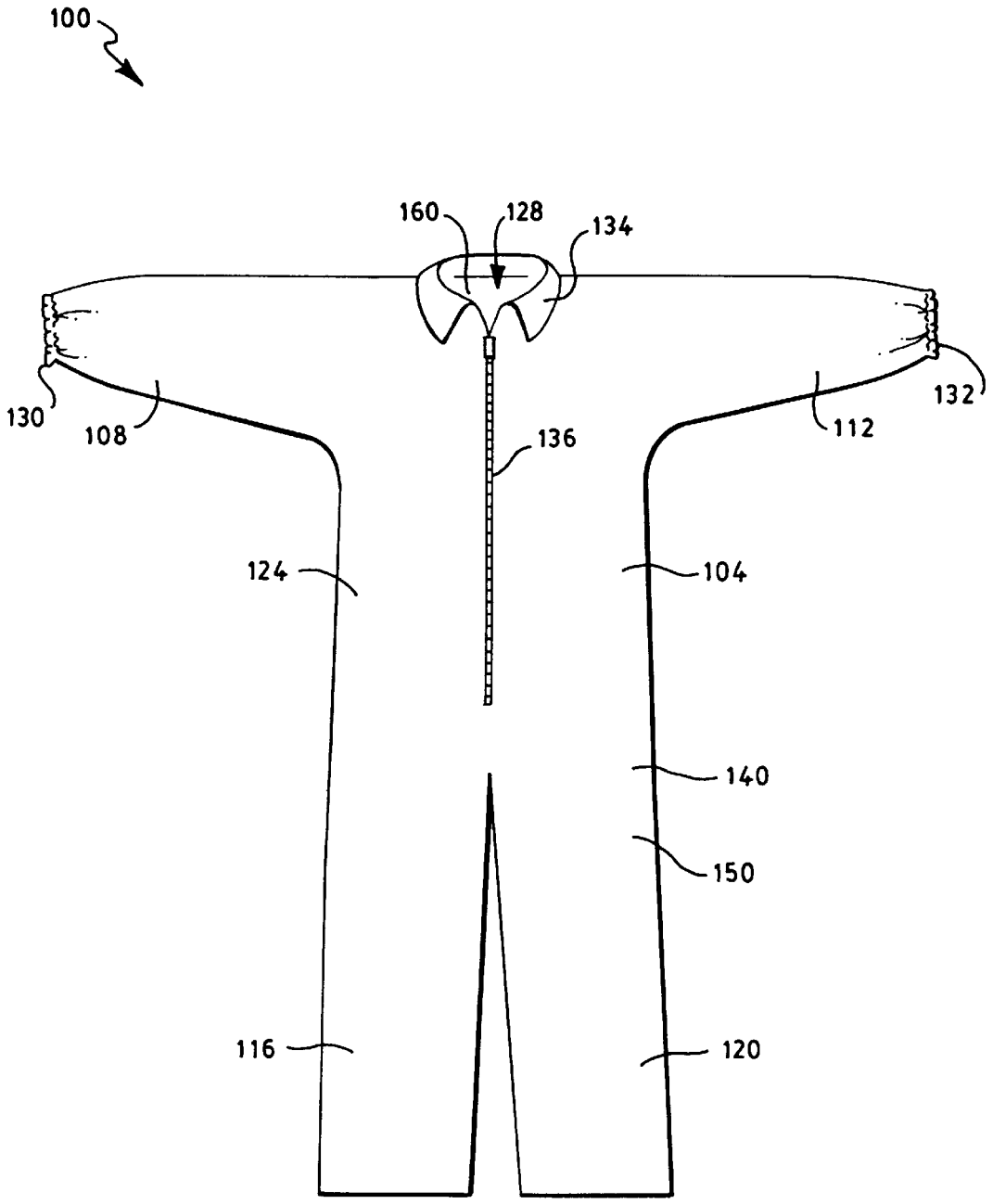
FIG. 1 is a front view of an exemplary padded protective garment.
Figure 2:
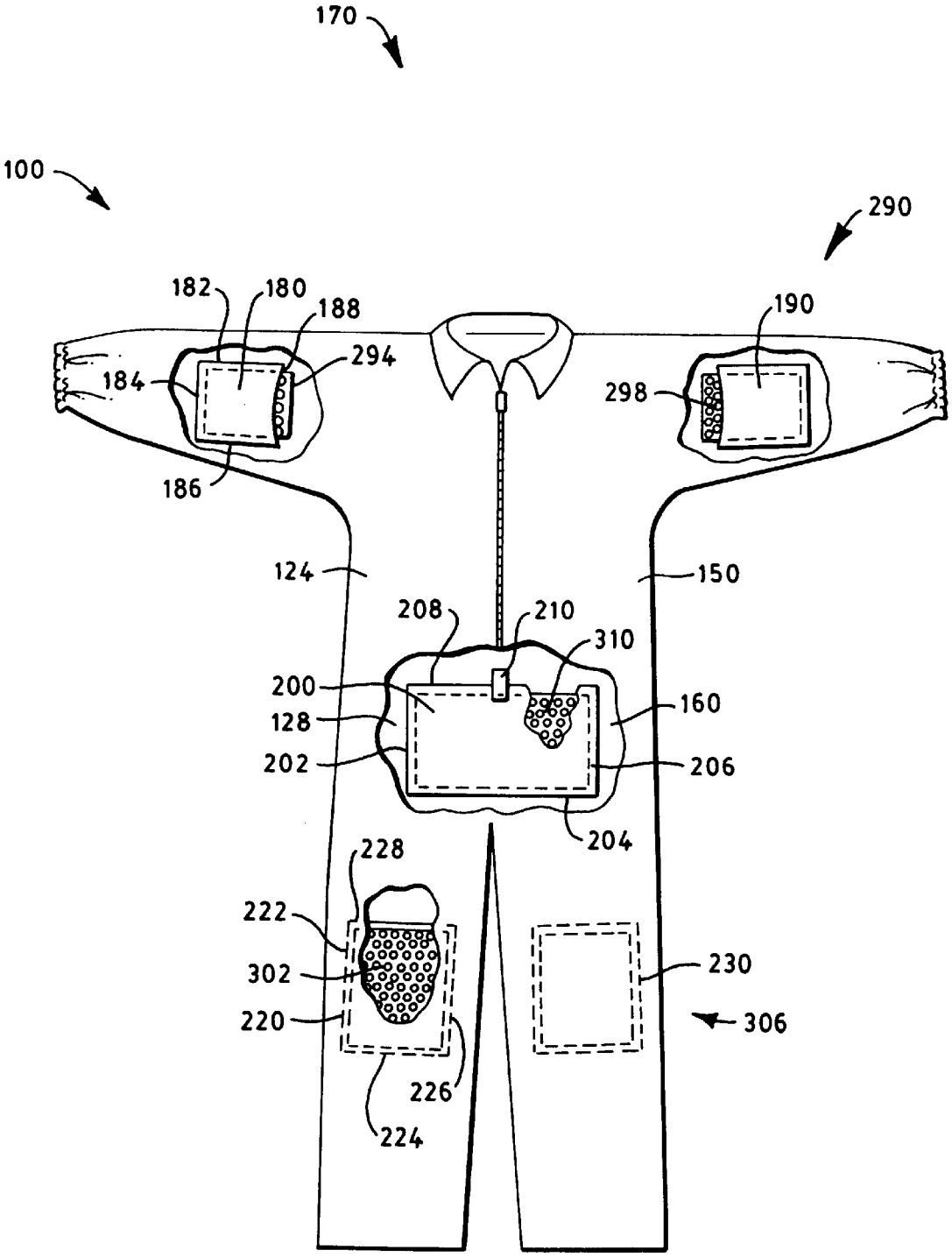
FIG. 2 is a cut-away view at varying depths illustrating exemplary pads and pockets of the present invention.

Referring now to the drawings, wherein the reference numerals designate corresponding structure throughout the views, and referring in particular to FIGS. 1–2, there is shown (not necessarily to scale) an exemplary improved disposable padded protective garment 100.

Referring to FIG. 1, the garment 100 includes a body section 104, first and second arm sections 108 and 112, and first and second leg sections 116 and 120. The exemplary garment 100 takes the form of a coverall, such as the coveralls disclosed in U.S. Pat. No. 5,487,189, entitled, "Coveralls Having Reduced Seams and Seamless Shoulder Construction And Method Of Manufacture", issued Jan. 30, 1996, to Bell and whose disclosure is hereby incorporated by reference. However, the garment 100 could also take the form of other articles of clothing, such as a coat, gowns, pants, or garments. Other exemplary garments are disclosed in U.S. Pat. No. 4,670,193, to Morell et al. and U.S. Pat. No. 5,509,142, which disclosures are hereby incorporated by reference.

The garment 100 further includes a first arm cuff 130, a second arm cuff 132, a collar 134, and a closure mechanism 136. The garment 100 could also include hood, boots, elastic waist, and/or elastic ankle cuffs. The garment also has e exterior 124 and an interior 128.

The garment 100 is constructed from a sheet material 140 that includes a first side 150 on the exterior 124 and a second side 160 on the interior 128 of the garment 100.

The sheet material 140 may be constructed from at least one bonded carded web, spunbonded filament web, or meltblown fiber web. Also, the sheet material 140 may include at least one knit material, woven material, or film.

The sheet material 140 may be formed from polymers, ethylene and at least one vinyl monomer copolymer, ethylene and n-butyl acrylate copolymer, cellulosic material, or acrylic resins. These compounds may be blended together. Examples of polymers may include polyamides, polyolefins, polyesters, polyvinyl alcohols, polyurethanes, polyvinyl chlorides, polyfluorocarbons, polystyrenes, and caprolactams. Examples of an ethylene and vinyl monomer copolymer may include poly(ethylene vinyl acetates). If the sheet material 140 is formed from a polyolefin, the polyolefin may be polyethylene, polypropylene, polybutene, ethylene copolymers, propylene copolymers and butene copolymers.

The sheet material 140 may have a basis weight ranging from about 15 grams per square meter (hereinafter may be abbreviated as "gsm") to about 300 gsm. Furthermore, the sheet material 140 may have a basis weight ranging from about 20 gsm to about 100 gsm. Desirably, the sheet material 140 may have a basis weight ranging from about 40 gsm to about 75 gsm. More desirably, the sheet material 140 may have a basis weight of about 44 gsm, about 61 gsm, or about 75 gsm.

The sheet material 140 may have a thickness less than about 12 millimeter (hereinafter may be abbreviated as "mil"). Furthermore, the sheet material 140 may have a thickness less than about 5 millimeter. Desirably, the sheet material 140 may have a thickness less than about 0.40 millimeter. More desirably, the sheet material may have a thickness of about 0.36 millimeter or about 0.33 millimeter.

An exemplary substance for the sheet material 140 is a spunbonded polypropylene continuous filament web. This web can be formed utilizing a conventional spunbonding process and is available from the Kimberly-Clark Corporation, Neenah, Wisconsin.

Another exemplary substance for the sheet material 140 is a high pulp content spunbonded continuous filament composite. Such a composite may have a wide range of basis weights and can be composed of about 84 percent, by weight, pulp and about 16 percent, by weight, spunbonded polypropylene continuous filament web. This composite can be formed essentially as described in U.S. Pat. No. 5,284,703, by C. H. Everhart, et al., entitled "High Pulp Content Nonwoven Composite Fabric", which disclosure is hereby incorporated by reference.

Yet another exemplary substance for the sheet material 140 may be a through-air bonded carded web, such as, for example a through-air bonded carded web composed of about 60 percent, by weight, polyester staple fibers and about 40 percent, by weight, bi-component polyethylene/polyester staple fibers. The web may be formed utilizing conventional carding equipment and thermally bonding the fibers utilizing a conventional heated through-air treatment or point bonding.

Generally, the sheet material 140 may be treated with compositions improving resistance to liquid and reducing static buildup, such as Zepel® and Zelec® available from E. I. du Pont De Nemours, or treated with compositions, such as hydrophilic surfactants.

Alternatively, the sheet material 140 may include multiple layers manufactured from the previously described polymers, copolymers, cellulosic materials, and resins forming a seamless laminate having desirable barrier properties.

For example, a useful multi-layer sheet material 140 may include at least one web of meltblown fibers, which may include meltblown microfibers, with at least one spunbonded continuous filament web. Another exemplary multi-layer sheet material 140 may include layers of spunbonded continuous filaments webs, meltblown fiber webs, a bonded carded web or other nonwoven fabric, resulting in an inexpensive sheet material 140 fairly well suited for disposable products.

Still another useful multi-layer sheet material 140 may consist of a three-layer fabric, incorporated into a garment, which is available from the Kimberly-Clark Corporation under the trade designation KLEENGUARD®. The three-layer fabric includes a first outer ply of a spunbonded web, a middle ply of a meltblown web, and a second outer ply of a spunbonded web (hereinafter may be abbreviated as "SMS"). These plies may be joined together by conventional thermal bonding techniques. If the SMS includes a polyolefin, it may be a random block copolymer of propylene and ethylene, which contains about 3 percent or more, by weight, ethylene. The fibers and/or filaments may be formed from blends that contain various pigments, additives, strengthening agents, and flow modifiers. Such fabrics are described in U.S. Pat. Nos. 4,041,203, 4,374,888, and 4,753,843, which disclosures are hereby incorporated by reference. Those patents are assigned to the Kimberly-Clark Corporation, the assignee of the present invention.

The multi-layer sheet material 140 may have a total basis weight of between about 15 gsm to about 300 gsm. For example, the multi-layer sheet material 140 may have a basis weight ranging from about 40 gsm to about 175 gsm.

Desirably, the multi-layer sheet material 140 may have a basis weight ranging from about 50 gsm to about 150 gsm.

For example, the multi-layer sheet material 140 may be a multi-layer nonwoven web of SMS construction, where each layer has a basis weight from about 9 gsm to about 70 gsm. Desirably, each layer may have a basis weight of from about 12 gsm to about 34 gsm. More desirably, each layer may have a basis weight of from about 14 gsm to about 27 gsm.

Desirably, the multi-layer sheet material 140 includes at least one film layer. Generally, the film will have a thickness ranging from about 0.025 mil to about 5.0 mil. For example, the film will have a thickness ranging from about 0.5 mil to about 3.0 mil. Desirably, the film will have a thickness ranging from about 1.0 mil to about 2.5 mil.

The films may be applied by extrusion coating the substrates and then passing the superposed materials through the nip of smooth calendar rolls. The films may be formed so they would create a layer on the substrate having a desired thickness.

Still another exemplary multi-layer sheet material 140 used for the present invention is a laminated fabric constructed by bonding together at least one layer of a nonwoven web with at least one layer of a film.

Generally, this laminated fabric may have a basis weight ranging from about 15 gsm to about 300 gsm. For example, the laminated fabric may have a basis weight ranging from about 20 gsm to about 150 gsm. As another example, the laminated fabric may have a basis weight ranging from about 20 gsm to about 75 gsm. Although the basis weight of the laminate will vary depending on the materials used, lower basis weight materials are desirable for comfort and conformability, while higher basis weight materials are desirable for toughness and durability. The laminated fabric permits combinations of materials providing high strength at relatively low basis weights.

Referring to FIG. 2, the garment 100 includes a plurality of pockets 170 and a plurality of pads 290. The plurality of pockets 170 and the plurality of pads 290 may be constructed from the previously described polymers, copolymers, cellulosic materials, and resins as the sheet material 140. It should be understood that any number of pockets and pads may be utilized with the garment 100. For example, it is possible that only one pad and/or pocket may be utilized with the garment 100.

The plurality of pockets 170 provides a means for coupling the plurality of pads 290 and includes a first elbow pocket 180, a second elbow pocket 190, a tailbone pocket 200, a first knee pocket 220, and a second knee pocket 230, and the plurality of pads 290 includes a first elbow pad 294, a second elbow pad 298, a first knee pad 302, a second knee pad 306, and a tailbone pad 310. The plurality of pockets 170 and pads 290 are exemplified as being substantially rectangular, but may be of any shape or size. Furthermore, the plurality of pockets 170 and pads 290 are desirably positioned in the interior 128 of the garment 100, although they may also be positioned on the exterior 124 of the garment 100 as well. In addition, the plurality of pockets 170 may be positioned at the same location on the interior 128 and exterior 124 of the garment 100.

The first and second elbow pockets 180 and 190 are substantially identical, as well as the first and second knee pockets 220 and 230. Consequently, only the first elbow pocket 180 and the first knee pocket 220 will be described in detail hereinafter.

The first elbow pocket 180 may include a first side 182, a second side 184, a third side 186, and a fourth side 188. Desirably, the first side 182, second side 184, and third side 186 are coupled, for example stitched, to the sheet material 140. This permits inserting and removing of the first elbow pad 294. Only stitching three sides 182, 184, and 186 to the sheet material 140 minimizes thread holes, which may allow moisture to enter the interior 128 of the garment 100. Alternatively, the fourth side 188 may be coupled to the sheet material 140 substantially permanently securing the first elbow pad 294 to the sheet material 140.

The tailbone pocket 200 may include a first side 202, a second side 204, a third side 206, and a fourth side 208. Desirably, the first side 202, second side 204, and third side 206 are coupled, for example stitched, to the sheet material 140. This permits inserting and removing of the tailbone pad 310. In addition, at least one adhesive strip 210 may be used to further secure the tailbone pad 310 within the pocket 200. Although only one adhesive strip 210 secures the tailbone pad 310, it is contemplated that other adhesive strips may be utilized to secure the other pads as well. Alternatively, the fourth side 208 may be coupled to the sheet material 140 substantially permanently securing the tailbone pad 310 to the sheet material 140.

The first knee pocket 220 may include a first side 222, a second side 224, a third side 226, and a fourth side 228. Desirably, the first side 222, second side 224, and third side 226 are coupled, for example stitched, to the sheet material 140. This permits inserting and removing of the first knee pad 302. Alternatively, the fourth side 228 may be coupled to the sheet material 140 substantially permanently securing the first knee pad 302 to the sheet material 140.

Figure 3:
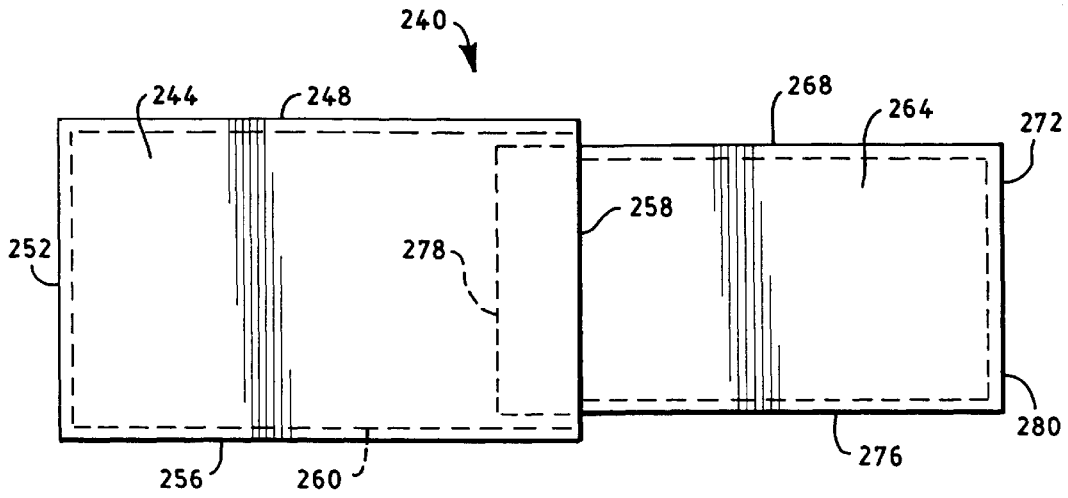
FIG. 3 is a front, elevational view illustrating an alternative embodiment of a pocket of the present invention.

Referring to FIG. 3, an alternative pocket 240 may include a first portion 244 and a second portion 264. The first portion 244 may include a first side 248, a second side 252, and a third side 256. Means for coupling, such as stitches 260, secure these sides 248, 252, and 256 to the sheet material 140 creating a first opening 258. The second portion 264 may include a first side 268, a second side 272, and a third side 276. Stitches 280 secure these sides 268, 272, and 276 to the sheet material 140 creating a second opening 278. The second opening 278 is within the first portion 244, thereby creating an overlap. After manipulating a pad, such as the first elbow pad 294, back and forth through both openings 258 and 278, the pad will remain relatively secure within the pocket 240.

Alternatively, the means for coupling the plurality of pads 290 may include using any suitable means, such as stitching, ultrasonic bonding, solvent welding, adhesives, adhesive tapes, mechanical fasteners, snaps, hook and loop connectors, clips, or thermal bonding.

Figure 4:
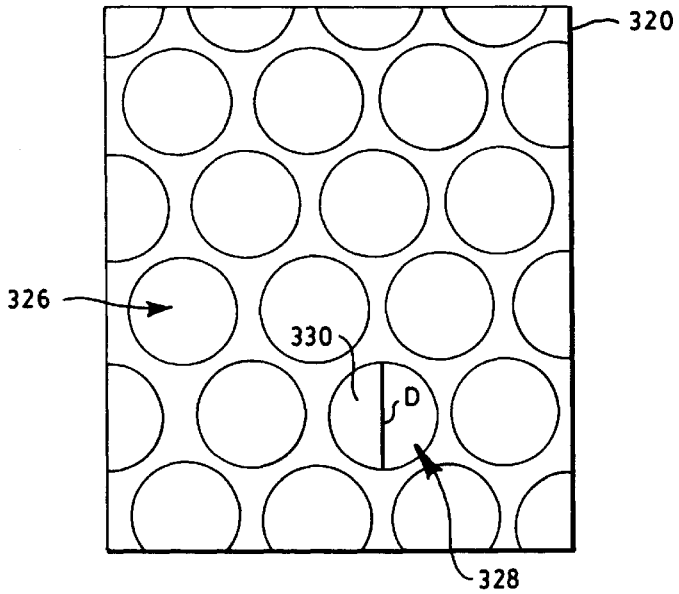
FIG. 4 is a front, elevational view illustrating a first member of an exemplary embodiment of a pad.
Figure 5:
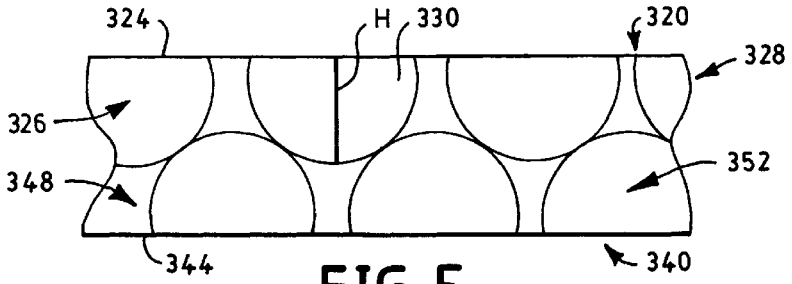
FIG. 5 is a partial side, elevational view illustrating an exemplary embodiment of a pad.

The plurality of pads 290 may be constructed from any suitable material, such as foams, textiles, fibers, or plastics. Referring to FIGS. 4 and 5, one suitable material includes a first member 320 and a second member 340. Both members 320 and 340 have substantially the same composition and form substantially the same structure. Consequently, only the composition and structure of the first member 320 will be described in detail hereinafter.

The first member 320 may be formed from polyethylene co-extruded with a nylon core creating a first substantially planar surface 324 and a second surface 326 forming a plurality of bubbles 328. One example of this material is sold under the trade designation AIRCAP® RECYCLED BARRIER BUBBLE™ Cushioning Material by Sealed Air Corporation, Packaging Products Division, 201 Mayhill St., Saddle Brook, N.J. 07663.

The plurality of bubbles 328 may be varied in size, although one desired member 320 has each bubble 330 having a diameter D of 1.27 centimeter and a height H of 1.27 centimeter. Furthermore, each bubble 330 encapsulates a substance, typically air. However, other fluids or materials, such as solid granules, may be used. In addition, the pressure within the plurality of bubbles 330 may also be varied.

In one desired embodiment, each pad of the plurality of pads 290 includes a first member 320 positioned with its plurality of bubbles 328 facing a plurality of bubbles 352 formed on a second surface 348 of the second member 340. Desirably, the plurality of bubbles 328 are offset and interlocked with the plurality of bubbles 352. As a result, the respective planar surfaces 324 and 344 of the first member 320 and second member 340 are directed outwards. The members 320 and 340 may be coupled using any suitable means, such as adhesives, to form a pad.

While the present invention has been described in connection with certain embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A padded protective garment comprising:

(a) a sheet material having a hydrostatic head of at least about 25 centimeters and a particle holdout efficiency of at least about 40 percent for particles having a diameter greater than about 0.1 micron, the sheet material defining an exterior and an interior side of the protective garment;

(b) at least one pad coupled directly against the interior side of the sheet material, wherein the at least one pad is adapted to cushion an impact in a region proximate to the position of the pad with respect to the sheet material; and (c) wherein the pad is coupled directly against the sheet material by means that do not penetrate the sheet material.

2. The disposable padded protective garment of claim 1, wherein the sheet material comprises first and second sides and the pad is coupled to the second side.

3. The disposable padded protective garment of claim 2, wherein the second side is located in an interior of the garment.

4. The disposable padded protective garment of claim 1, wherein the sheet material is less than about 5.0 millimeter thick.

5. The disposable padded protective garment of claim 4, wherein the sheet material is less than about 0.40 millimeter thick.

6. The disposable padded protective garment of claim 1, wherein the garment comprises a body section and arm sections.

7. The disposable padded protective garment of claim 6, wherein the garment further comprises leg sections.

8. The disposable padded protective garment of claim 6, further comprising pads coupled to the sheet material at locations corresponding to the elbows of a wearer.

9. The disposable padded protective garment of claim 7, further comprising pads coupled to the sheet material at locations corresponding to the elbows, knees, and tailbone of a wearer.

10. The disposable padded protective garment of claim 1, wherein the pad includes a foam material.

11. The disposable padded protective garment of claim 1, wherein the pad comprises a first member having a first substantially planar surface and a second surface forming a plurality of bubbles.

12. The disposable padded protective garment of claim 11, wherein the pad further comprises a second member having a first substantially planar surface and a second surface forming a plurality of bubbles wherein the second member is positioned with its second surface in opposing relation to the second surface of the first member.

13. The disposable padded protective garment of claim 12, wherein the plurality of bubbles of the second member are offset with the plurality of bubbles of the first member.

14. The disposable padded protective garment of claim 1, wherein the sheet material includes material selected from the group consisting of a polymer, an ethylene and vinyl monomer copolymer, an ethylene and n-butyl acrylate copolymer, a cellulosic material, and an acrylic resin.

15. The disposable padded protective garment of claim 14, wherein the sheet material includes at least two layers.

16. A method of making a padded protective garment, comprising the steps of:

providing a sheet material having a hydrostatic head of at least about 25 centimeters and a particle holdout efficiency of at least about 40 percent for particles having a diameter greater than about 0.1 micron, and forming the sheet material into a protective garment having an exterior side and an interior side;

providing a pad; and attaching the pad at a location on the interior side of the garment directly against the sheet material without penetrating the sheet material;

wherein the pad is adapted to cushion an impact in a region proximate to the position of the pad with respect to the sheet material.

17. The method of claim 16, wherein the step of attaching the pad comprises attaching the pad directly against the sheet material by a method selected from the group consisting of, ultrasonic bonding, solvent welding, adhesives, and thermal bonding.

18. The method of claim 16, wherein the pad comprises a first member having a first substantially planar surface and a second surface forming a plurality of bubbles.

19. The method of claim 18, wherein the pad further comprises a second member having a first substantially planar surface and a second surface forming a plurality of bubbles wherein the second member is positioned with its second side in opposing relation to the second side of the first member.

20. The method of claim 19, wherein the plurality of bubbles of the second member are offset with the plurality of bubbles of the first member.

21. A disposable padded protective garment comprising:

a body section, arm sections, and leg sections wherein these sections include a sheet material less than about 5.0 millimeter thick formed from a material having a hydrostatic head of at least about 25 centimeters and a particle holdout efficiency of at least about 40 percent for particles having a diameter greater than about 0.1 micron selected from the group including a polymer, an ethylene and vinyl monomer copolymer, an ethylene and n-butyl acrylate copolymer, a cellulosic material, or an acrylic resin;

pads at locations corresponding to the elbows, knees, and tailbones of a wearer wherein each pad is coupled directly to a second side of the sheet material located in an interior of the garment; and wherein each pad further comprises a first member having a first substantially planar surface and a second surface forming a plurality of bubbles and a second member having a first substantially planar surface and a second surface forming a plurality of bubbles positioned with its plurality of bubbles in an offset and opposing relations with the plurality of bubbles of the first member, wherein the pads are adapted to cushion an impact in a region proximate to the position of the pad with respect to the sheet material.

* * * * *